US006419284B1

(12) United States Patent
Kutschat

(10) Patent No.: US 6,419,284 B1
(45) Date of Patent: Jul. 16, 2002

(54) DOOR LOCK, IN PARTICULAR FOR TRACTORS

(75) Inventor: Horst Kutschat, Wuppertal (DE)

(73) Assignee: D. la Porte Söhne GmbH, Wuppertal (DE)

( * ) Notice: Subject to any disclaimer, the term of this patent is extended or adjusted under 35 U.S.C. 154(b) by 58 days.

(21) Appl. No.: 09/692,707

(22) Filed: Oct. 20, 2000

(30) Foreign Application Priority Data

Oct. 28, 1999 (DE) ..... 199 52 012

(51) Int. Cl.[7] ..... E05C 9/12

(52) U.S. Cl. ..... 292/56; 292/214; 292/216; 292/DIG. 23

(58) Field of Search ..... 292/216, 56, DIG. 23, 292/201, 214, DIG. 42, DIG. 43

(56) References Cited

U.S. PATENT DOCUMENTS 2,582,926 A * 1/1952 Dall ..... 292/216
2,807,492 A * 9/1957 Jakeway ..... 292/336.3
4,913,477 A * 4/1990 Watanuki et al. ..... 292/216
5,738,393 A * 4/1998 Chao ..... 292/216
6,012,747 A * 1/2000 Takamura et al. ..... 292/216
6,158,787 A * 12/2000 Kutschat ..... 292/214

* cited by examiner

*Primary Examiner*—Teri Pham Luu
(74) *Attorney, Agent, or Firm*—Goodman & Teitelbaum, Esqs.

(57) ABSTRACT

The invention relates to a door lock, in particular for agricultural vehicles such as tractors, containing a lock case and a locally actuable release arrangement, it being the case that provided in the lock case are spring-assisted rotary-latch elements, for engaging around the locking bolt, and a catch lever which fixes the rotary positions of the two rotary-latch elements, belongs to the release arrangement and is intended for rotary-latch-element-securing engagement in the latching-action element-toothing formations, which are directed away from the rotary latch, it being the case that the catch lever is connected to a second, remotely actuable release arrangement (12), which is guided and arranged in a crossmember tube (24) which can be pivoted in relation to the lock case, the release arrangement (12) being connected to the catch lever via a cable or a rod and the release arrangement (12) being arranged on the crossmember tube (24) such that it can be displaced longitudinally and secured, with the result that the crossmember tube (24) can be pivoted in relation to the lock case (5) and the release arrangement can be adapted to the pivot angle.

64 Claims, 6 Drawing Sheets

DOOR LOCK, IN PARTICULAR FOR TRACTORS

The invention relates to a door lock according to the preamble of Claim 1.

Such a door lock which is designed as a rotary-latch lock and is intended for a vehicle door is described in U.S. Pat. No. 3,666,305. In said document, the said rotary-latch lock has a pair of rotatably mounted rotary latch elements which can be pivoted counter to one another and retain a locking bolt in the rotary latch by means of a blocking lever of the locally actuable release arrangement. For actuation and/or release of the blocking lever by a blocking-lever actuator, the rotary-latch elements pivot away from one another into an unlatched position, which makes it possible for the vehicle door to be opened. For closing the rotary latch, the blocking lever is aligned in a pivotable manner such that, once the user lets go of the blocking-lever actuator, said lever is moved back into engagement with the rotary-latch elements. Under the aligning force, the blocking lever remains in a supporting relationship with the surfaces of rotary-latch elements and moves into a rotary-latch-element blocking position, in which case the rotary-latch elements enclose the locking bolt. Each of the rotary-latch elements has a toothing formation provided on its outer surface, on the rear side of the rotary latch, which is positioned such that they engage in a cam surface of the arm of the blocking lever with mating latching action and guide the same into such a rotary-latch-element position that, in the case of a normal position, they cannot be adjusted.

DE-A 30 10 388 discloses another motor-vehicle door lock, which is provided with a snap-action element which is arranged on a base plate, can be moved into a snapped-in and a non-snapped-in position, comprises two rotary-latch elements and interacts with a catch which retains a locking bolt in the snapped-in position and, upon actuation for movement into the non-snapped-in position, releases said locking bolt and can be actuated via an actuating lever. A pin/slot connection is provided between the actuating lever and the base plate such that the actuating lever can be moved between a normal position and an actuating position and can be displaced as a whole between a coupled position and a decoupled position in relation to the catch. In the coupled position, the actuating lever can be brought into engagement with the catch and moves the latter such that the locking bolt is released when the actuating lever assumes the coupled position and is moved from the normal position into the actuating position. The actuating lever is idling in relation to the catch when it is located in the decoupled position and moves from the normal position into the actuating position without actuating the catch for release of the locking bolt. Also provided is a blocking lever which can be moved between a locking and unlocking position and is connected to the actuating lever via a connecting element, this comprising a protrusion on one lever and a protrusion-accommodating slot in the second lever. The protrusion interacts with the edges of the slot such that, when the blocking lever is moved from the unlocking position into the locking position, the actuating lever is displaced as a whole from the coupled position into the decoupled position. The slot is configured such that, with the actuating lever located in the coupled or decoupled position and moved from the normal position to the actuating position, the protrusion can be moved in the slot.

EP 0 849 424 A1 describes a vehicle-door lock of the generic type, which constitutes a rotary-latch lock for locking a door, in particular a tractor door. The rotary latch, made of two rotary-latch elements, interacts with a rotary-latch spring and a latching member, it being possible for the rotary latch and the latching member to be pivoted and to interact—with the lock being locked in the process. The locking can be released by a lever system which has an actuating lever and acts on the latching member. The latching member can be actuated on a lever-system latching arm which is mounted such that it can be pivoted about a first axis and is in operative connection with an opening lever which can be pivoted about a second axis. The first and the second axes are aligned parallel to one another, there being provided a connecting means, which brings a respective free end of the latching arm and of the actuating lever into operative connection. In this case, the latching arm and the actuating lever can be pivoted in the same direction about their pivot axes.

The known door locks can be actuated by a handle or lever from the outside of the door and by a second lever from the inside of the vehicle, it being the case that a local-release means, i.e. a release mechanism arranged directly on the lock, is actuated usually from outside the vehicle, and the means for actuation from the inside of the vehicle is a remote-release means or remote-actuating means, i.e. for example the means for actuating the lock via a steel wire or an articulating rod.

The disadvantage here is that the remote-release means or remote-actuating means is difficult to adapt to various types of door and that, in particular with the high level of vibration in tractors or other agriculture vehicles, lever systems with multiple transmissions and points of articulation are subjected to loading by vibrations and permanently damaged. Furthermore, cab doors of tractors and other agriculture vehicles, for example combine-harvesters, are designed as full-vision cab doors, i.e. to be transparent without any cavities. Such doors often only have a peripheral tube system as load-bearing elements, with result that conventional remote-release mechanisms such as lever or cable systems cannot be arranged inside a door.

The object of the invention is to provide a door lock, in particular for agricultural vehicles, which is designed such that the remote-actuating means, in particular from the inside of the vehicle, can easily be adapted to different types and shapes of door and can be installed quickly on a door, the mechanism, while being straightforward to install, being particularly robust in relation to vibration loading.

The object is achieved by a door lock having the features of claim 1, and advantageous designs and developments are characterized in the subclaims.

In the door lock, according to the invention, the catch lever is connected to a remotely actuable release arrangement, which is guided and arranged in a crossmember tube, such that the crossmember tube can be pivoted as desired into at least one plane in relation to the lock case, the crossmember tube accommodating the remote-release mechanism. The mechanism is thus designed such that the tube may also have an angled, inflected progression without the reliability of the mechanism being adversely affected. In addition, the actuating lever of the remote-release means is mounted in the tube in a longitudinal displaceable manner.

The lock case constitutes a depression-like or case-like container which has, as contiguous wall parts, a depression base, a first short-side lock wall, a second, opposite short-side lock wall and a first long-side lock wall, the second long-side lock wall being divided in two and comprising a first lock-wall part and a second-lock wall part, the case opening being located approximately centrally between the two lock-wall parts, and it being possible for the locking bolt to be moved into the lock case and out of the lock case through said opening.

The two interconnected lever arms of the catch lever are a vertical lever arm and a horizontal lever arm with an associated angle region, the vertical lever arm having the latching member, preferably in the end region and being directed approximately parallel to the long-side lock wall, and the horizontal lever arm being directed approximately parallel to the short-side lock wall and extending into the corner region of the lock walls, alongside the bottom rotary-latch element.

The horizontal lever arm of the catch lever is connected to the remotely actuable release arrangement, which can be actuated preferably from the inside, and the remote-release lever thereof.

The vertical lever arm of the catch lever, said arm being assigned to the rotary latch, is connected to the handle-actuable release arrangement and the local-release lever thereof.

The remote-release lever and the local-release lever are assigned to the catch lever independently of one another, the remote-release lever being connected to the horizontal lever arm via an end-side engagement element in each case, and the local-release lever being connected to the vertically directed lever arm.

The catch lever is spring-assisted, the pressure of the spring being directed in the direction of the rotary latch.

The door-handle-actuable release arrangement is provided with a pivotable door handle which is incorporated in a door-handle depression, the door handle being connected to a lever device, fastened on the door-handle depression, and a platform, fastened on said lever device, in the direction transverse to the door-handle depression, the local-release lever being pivotable by virtue of the movement of the platform.

The release arrangement which can be actuated by a button inside the door comprises, outside the lock case, a preferably step-like tube-retaining angle part, a pivotable crossmember tube, which is fastened on said angle part, is open in the direction of the lock case and is provided at the other, free end with a tube crimping formation which can be installed in a door-adapted manner and is provided with a slot, and also comprises a contact device, which is located on and in the crossmember tube and from which a tension cable, reinforced at the end by a cable hook, is guided to the perforated remote-release lever which is connected to the tube-retaining angle part and is ready for accommodating the cable hook.

The tube-retaining angle part comprises the angle-part member, which is fastened or integrally formed vertically preferably on the border side of the bottom cover part, a step spacer part, which is offset to the side of the lock case from the cover part, and a tube-retaining part, one end side of the crossmember tube being fastened thereon, preferably screwed thereto.

The tube-retaining angle part constitutes a securing and spacer element which is minimalized in terms of material and shape.

The first short-side lock wall has a preferably rectangular cutout opening in the corner region, between the first long-side lock wall and the cover part.

The cover is divided in two into a first, bottom cover part and a second, top cover part, there being provided on the first, bottom cover part a projecting rotary-hole extension which is angled outwards at right angles, to which the local-release lever is screwed in a pivotably mounted manner, and on which the tube-retaining angle part is integrally formed, the crossmember tube being fastened on said angle part.

Both the rotary-hole extension and the tube-retaining angle part are arranged preferably on a cover part, at right angles to one another.

The tension cable or the rod is connected to the functional interior of the lock case via the engagement continuation and the remote-release lever, which is mounted such that it can be pivoted about the axis.

The remote-release lever is fastened on the tube-retaining angle part by means of the rotary-mounting screw, a window being provided in the lock case, in particular in the bottom cover part, in the region of the remote-release lever, in order that the catch lever, which can be pivoted in the lock case, can be actuated via the engagement continuation, which is integrally formed on the remote-release lever.

The crossmember tube, preferably with associated tube crimping formation located at the free tube end, is fastened on the tube-retaining part of the tube-retaining angle part such that it can be adjusted via the tube-securing block and the screw-connection.

The catch lever can be actuated by means of the remote-release lever or by means of the local-release lever independently of one another.

The two release levers may be connected to the catch lever, in particular to the lever arms thereof, via further different recessed, corresponding latching elements which are introduced.

The crossmember tube of the button-actuable release arrangement is fastened pivotably on, in particular screwed to, the tube-retaining part of the step-like tube-retaining angle part.

In the crossmember tube, the tension cable or the rod is guided up to the contact device, which is arranged preferably centrally on the crossmember tube and is directed vertically upwards out of the cut-open tube.

On the angle-part member, which is located outside the lock case, the remote-release lever is provided in a pivotably mounted manner by means of the rotary-mounting screw.

Integrally formed on the remote-release lever is a cable mount which is provided with a securing hole, the securing hole securing the cable hook, which is reinforced in relation to the tension cable or the rod, and the cable mount and the engagement continuation being directed preferably in parallel.

The crossmember tube has on its top side, preferably in the longitudinal centre, a longitudinal-slot opening and an arresting-action longitudinal tube opening, in which the contact device with the button is fastened in a longitudinally displaceable manner.

The button is connected to a button-retaining body which is located in the tube and comprises a clamping-body part, which is assigned to the arresting-action longitudinal tube opening in the crossmember-tube region, and a button-retaining-body part assigned to the lateral body.

Provided outside the outer tube wall are a clamping screw, which can be actuated preferably by a socket-head-screw wrench, and a clamping ring, which is located between the clamping-screw head and outer tube wall and by means of which the button-retaining body, and thus also the angle $\alpha$ of a rocker-like pivoting body, can be arrested in a manner in which they have been adjusted in relation to the inner tube wall.

The clamping-body part is designed to be preferably equal to or narrower than the width of the longitudinal-slot opening, for straightforward installation of the contact device in the crossmember tube.

In the transition region from the arresting-action longitudinal tube opening to the longitudinal-slot opening, the clamping-body part is provided respectively with a left-hand transverse stop edge and a right-hand transverse stop edge, which are directed transversely to the progression of the tube and each run up to the contact-body centre part, which terminates, in the longitudinal direction of the tube, a little way above the retaining-body bearing, the contact-body side parts butting, by way of their continuing border regions, against the transverse stop edges of the clamping-body part such that the button is secured in a predetermined state in its normal position.

The invention will be explained in more detail by way of example with reference to an exemplary embodiment and by means of a number of drawings, in which:

FIG. 1 shows a plan view of a door lock according to the invention with a locally actuable release arrangement and a remotely actuable release arrangement;

FIG. 1*a* shows an enlarged illustration of the lock case and of the two release levers, in the vicinity of the lock case, of the two actuable release arrangements according to FIG. 1;

Figure 6:
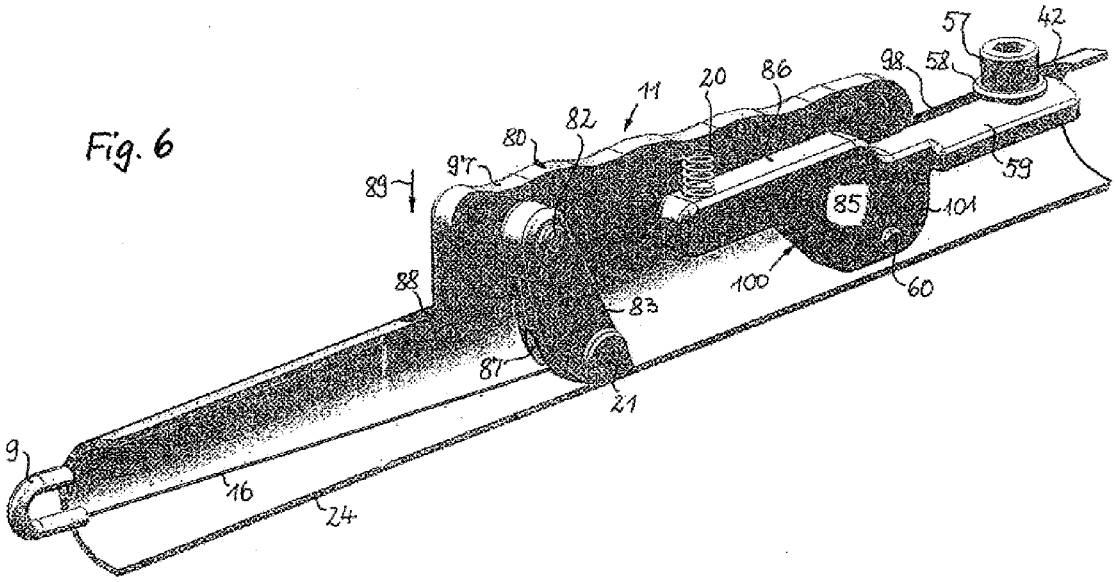
FIG. 6 shows a perspective illustration of the contact device inside the door, with a tension cable and with a crossmember tube cut away longitudinally.
Figure 6A:
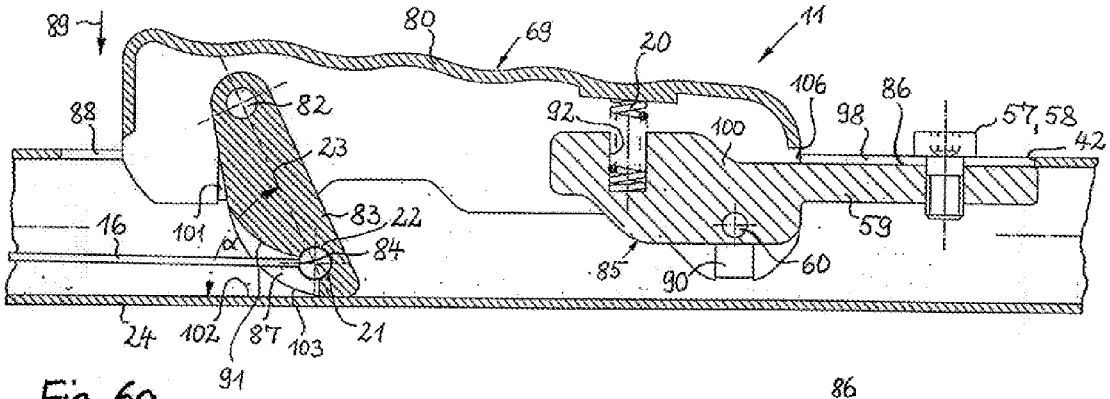
Figure 6B:
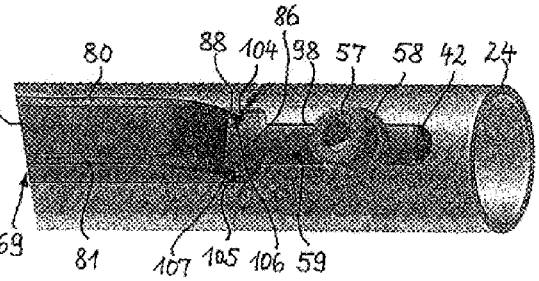

FIG. 6*a* shows an illustration in longitudinal section of the contact device for the remotely actuable release arrangement with crossmember tube according to FIG. 6; and FIG. 6*b* shows a perspective illustration of the adjustable contact device, which can be arrested by a clamping-action screw-connection, on the crossmember tube according to FIG. 6.

In FIGS. 1 to 6*b*, the same designations are used throughout for the same parts with the same functions.

Figure 1:
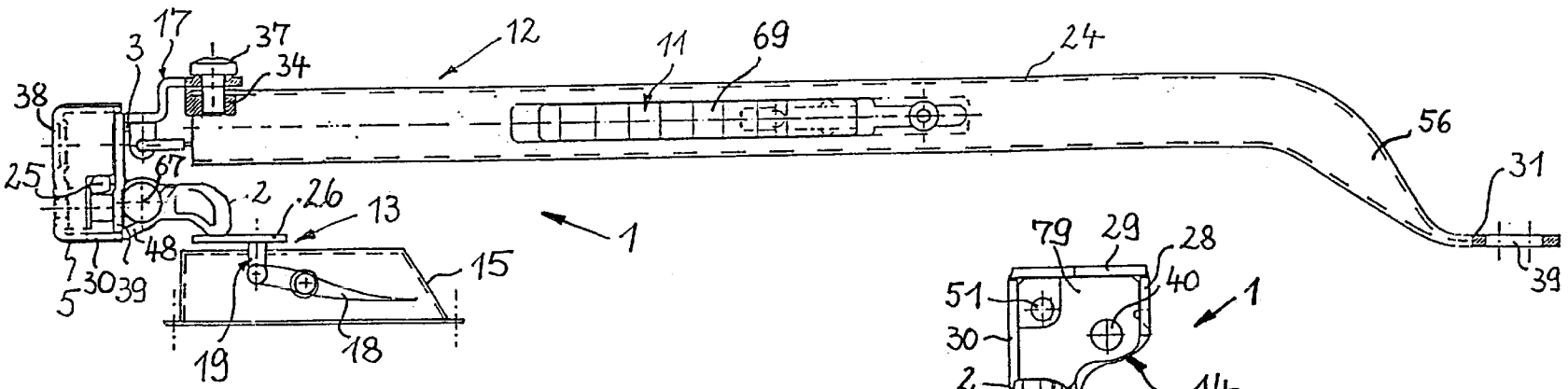
Figure 1A:
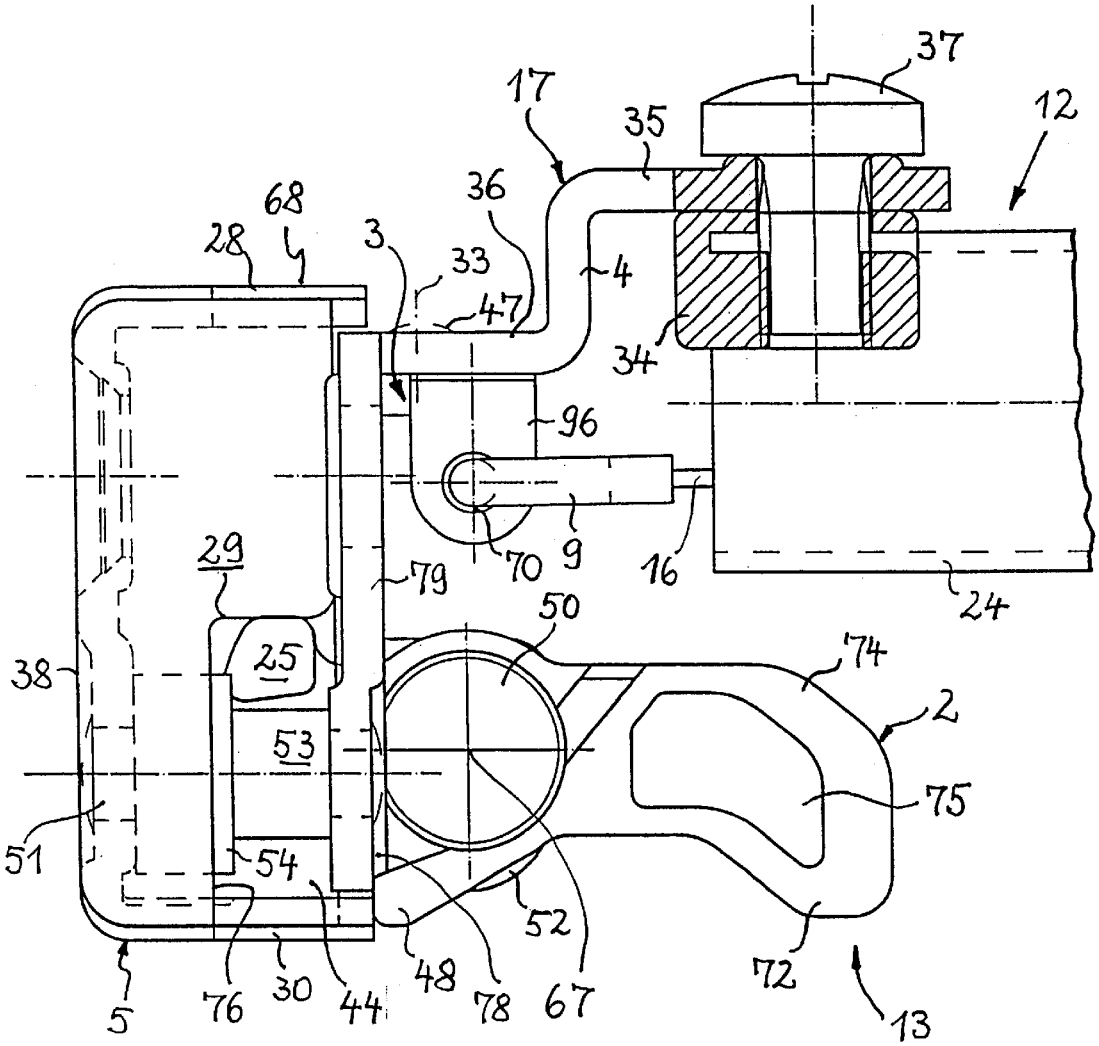

FIGS. 1 and 1*a* will be looked at together for the time being. FIG. 1 shows essentially the door lock 1 according to the invention with a locally actuable release arrangement 13 and with a remotely actuable release arrangement 12.

In this case, the locally actuable release arrangement 13 constitutes a release arrangement which can be actuated preferably by a door handle from outside the door. The remotely actuable release arrangement 12 constitutes a release arrangement which can be actuated by a button preferably inside the door.

The door-handle-actuable release arrangement 13 shown in FIG. 1 has, outside the lock case 5, a manually actuable pivotable door handle 18 which is incorporated in a door-handle depression 15, the door handle 18 being connected to a lever device 19, fastened on the door-handle depression 15, and a platform 26, fastened on said lever device, in the direction transverse to the door-handle depression 15, the local-release lever 2 being mounted such that it can be pivoted about the axis 67 by virtue of the movement of the platform 26.

The local-release lever 2, as is shown in FIG. 1*a*, is connected, within the lock case 5, to a blocking bolt 25, which projects from the plane of the drawing and, when the local-release lever 2 is pivoted, can likewise be pivoted, the blocking bolt 25 being assisted by a compression spring (not depicted). Furthermore, the local-release lever 2 has a supporting protrusion 48 which is located outside the lock case 5 and, in the normal position, has its end butting against the lock case 5.

Figure 3:
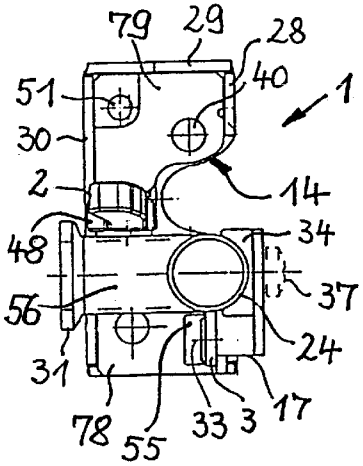
FIG. 3 shows a side view in the direction of the cover parts of the door lock according to FIG. 1, said door lock being designed with two differently actuable release arrangements.

At the free end outside the lock case 5, in order to be advanced closer up to the platform 26, the local-release lever 2 is provided with a slightly twisted head 74 which has a protrusion 72 and, as is shown in FIG. 3, is inclined away from the button-actuable release arrangement 12, a through-passage 75 of the head 74 reducing the amount of material required for said head and rendering the latter, inter alia, easier to operate.

The release arrangement 12, which can be actuated by a button inside the door, comprises, outside the lock case 5, a preferably single-step tube-retaining angle part 17, a pivotable crossmember tube 24, which is fastened on said angle part, is open in the direction of the lock case 5 and has at the other, free end a tube crimping formation 31 which can be installed in a door-adapted manner and is provided with a slot 39, the crossmember tube 24 merging into the tube crimping formation 31 via a bent tube-criming tapered portion 56 which is directed towards the outer depression. The remotely actuable release arrangement 12 also contains. a contact device 11, which is located on and in the crossmember tube 24 and from which a tension cable 16, reinforced at the end by a cable hook 9, is guided to a remote release lever 3 which is connected to the tube-retaining angle part 17 and accommodates the cable hook.

The preferably metallic lock case 5, in FIGS. 1 and 1*a*, is in the form of a laterally closed depression, of which the wall parts are produced by being bent appropriately at right angles preferably from an integral cut-open basic part, the essential functional interior of the door lock 1 being contained in the depression. The lock case 5 has a depression base 38, a first short-side lock wall 29 and a second, opposite short-side lock wall 44 and a first long-side lock wall 30, the second long-side lock wall being divided in two and comprising a first lock-wall part 28 and a second lock-wall part 68. It is also the case that the cover is divided in two into a first, bottom cover part 78 and a second, top cover part 79, there being provided on the first, bottom cover part 78 a projecting rotary-hole extension 52 which is angled outwards at right angles, to which the local-release lever 2 is screwed in a pivotably mounted manner, and on which a tube-retaining angle part 17 is integrally formed, the crossmember tube 24 being fastened on said angle part. Both the rotary-hole extension 52 and the tube-retaining angle part 17 are arranged at right angles to one another.

The first short-side lock wall 29 has a preferably rectangular cutout opening 76 in the corner region, between the first long-side lock wall 30 and the cover part 79.

In FIG. 1*a*, the top cover part 79 is fastened, by means of the screw-connection 51, on the depression base 38, and by means of the interposed spacer sleeves 53, 54. The tube-retaining angle part 17 is attached to, integrally formed on or screwed to the bottom cover part 78, which is secured firmly on the depression base 38 likewise by means of two screw-connections (not depicted in FIGS. 1, 1*a*).

Figure 2:
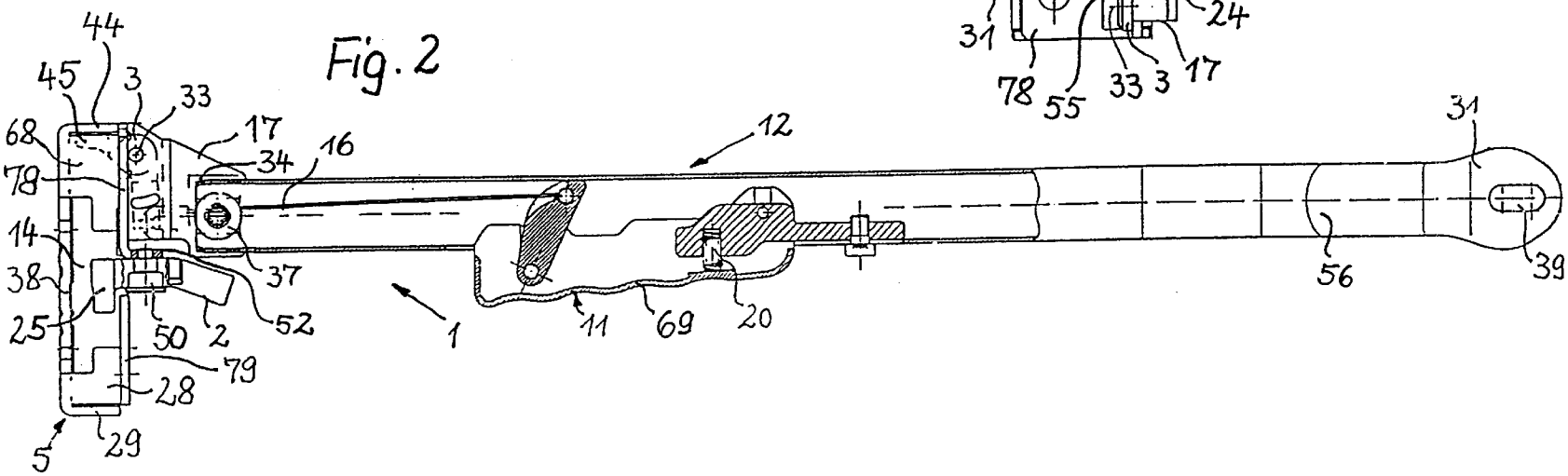
FIG. 2 shows a plan view of the door lock without an outer door depression for the locally actuable release arrangement according to the illustration in FIG. 1.

FIG. 2 illustrates FIG. 1 in plane view. The lock case 5 has the depression base 38, the lock-wall parts 28 and 68 and the short-side lock walls 29, 44. Provided between the lock-wall parts 28, 68 is the case opening 14, which is provided for the movement of the rotary-latch elements 7, 8 beyond the plane of the lock-wall parts 28, 68.

Arranged between the spaced-apart cover parts 78, 79 is the local-release lever 2, which is secured in a pivotably mounted manner on the outwardly angled rotary-hole extension 52 by means of the rotary-mounting screw 50. In the lock case 5, the blocking bolt 25, which is provided at the other end of the local-release lever 2, is integrally formed in the direction of the short-side lock wall 29.

The bottom cover part 78 is a securing part not just for the local-release lever 2 but also for the remote-release lever 3, which is mounted and secured pivotably on the tube-retaining angle part 17, which is integrally formed on the bottom cover part 78.

The tension cable 16 is connected to the functional interior of the lock case 5 via the remote-release lever 3, which is mounted such that it can be rotated about the axis 33, and the engagement continuation 45 of said lever.

FIG. 3 shows a side view from the side of the two release arrangements 12, 13 according to FIG. 1. The lock case 5 is illustrated in an upright state, as it is installed in the door. The depression base 38 has the case opening 14, in which the locking bolt 6 engages when the door is closed. The locking bolt 6 remains in the case opening 14 as long as the rotary-latch elements 7, 8 (not depicted) engage around it with securing action.

The top cover part 79 is fitted in an edge-levelled manner into the lock walls 30, 29, 28 by the screw-connections/rotary securing screws 51 and 40 including the spacer sleeves which are arranged between the depression base 38 and cover part 79, while the bottom cover part 78 is fitted in a levelled manner between the lock walls 30, 68 and rests on the short-side lock wall 44. It is also the case that the second, bottom cover part 78 is secured by two screw-connections/rotary securing screws 43, 93, which are supported by spacer sleeves 94, 95 inside the lock.

The remote-release lever 3 is fastened on the tube-retaining angle part 17, such that it can be pivoted about the axis 33, by means of the rotary-mounting screw 47. A preferably rectangular window 55 is provided in the lock case 5, in particular in the bottom cover part 78, in the region of the remote-release lever 3, in order that the catch lever 27, which is located in the lock case 5, can be actuated via the engagement continuation 45, which is integrally formed on the remote-release lever 3.

In the loading-free case (normal position), the supporting protrusion 48, which belongs to the local-release lever 2, rests preferably on the edge of the long-side lock wall 30. The local-release lever 2 may contain a central slot cutout by means of which it can be displaced in relation to the platform 26 and can be arrested by means of the rotary-mounting screw 50.

The crossmember tube 24, with the associated tube crimping formation 31, is fastened on the tube-retaining angle part 17 such that it can be adjusted via the tube-securing block 34 and the screw-connection 37.

Figure 4:
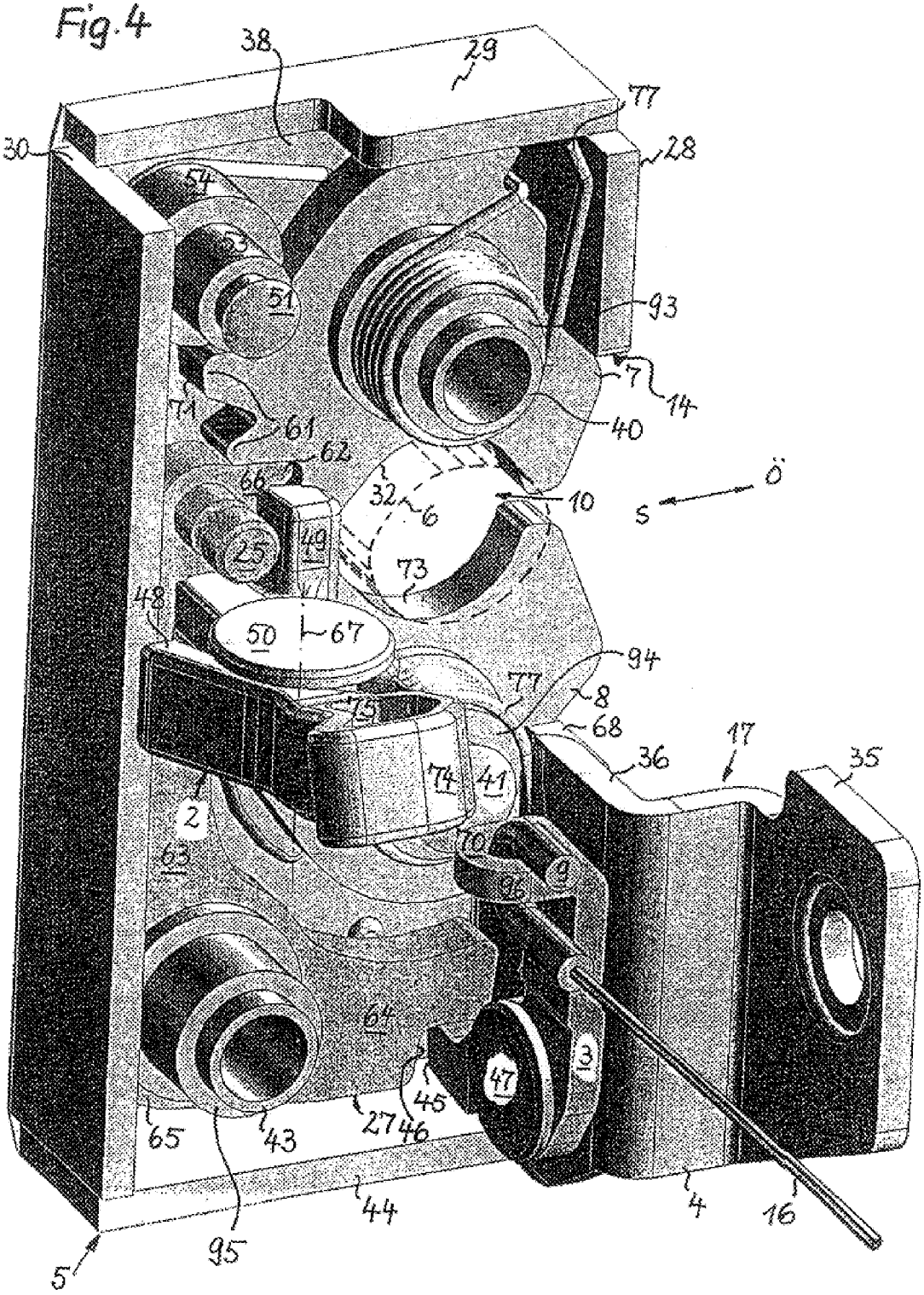
FIG. 4 shows a perspective illustration of the essential interior of the door lock according to the invention with a local-release lever, a remote-release lever, a catch lever and a rotary latch assisted by a spring.
Figure 5:
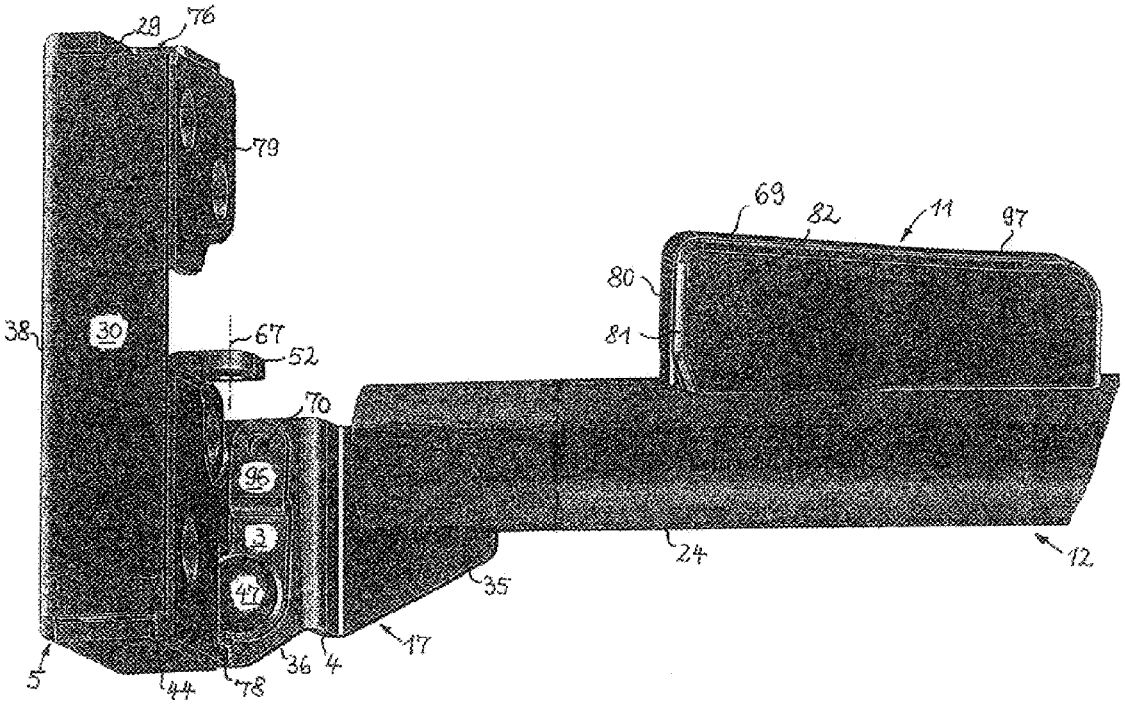
FIG. 5 shows a perspective view of the housing of the lock case with crossmember tube, fastened thereon, with contact device inside the door, without a tension cable.

FIGS. 4 and 5 will be looked at together hereinbelow, it being possible for the door lock 1 according to the invention to be inserted into left-hand doors of vehicles in the upended position given. The same also applies to right-hand doors. FIG. 4 shows largely the functional interior of the lock case 5 of the door lock 1 according to the invention in a perspective illustration and in the open state. The door lock 1 contains a lock case 5, which is provided with a case opening 14 and accommodates a locking bolt 6 of the vehicle there, and the door-handle-actuable local-release lever 2, it being the case that provided in the lock case 5 are a rotary latch 10, which is assisted by a spring 77 and is intended for engaging around the locking bolt 6 passing through the case opening 14, and a catch lever 27 which fixes the rotary positions of the two rotary-latch elements 7, 8, is of flat design and is intended for rotary-latch-element-securing latching engagement in the latching-action element-toothing formations 61 (61 is a designation which represents the latching-action element-toothing formations of the two rotary-latch elements 7, 8), which are directed away from the rotary latch 10. The flat catch lever 27 has two lever arms 63, 64, running approximately at right angles to one another, and is mounted pivotably in the corner of the associated angle region 65 by means of a rotary securing bolt 43, which has a spacer sleeve 95. Furthermore, the catch lever 27 has a latching member 66 which belongs to the end side of the vertical lever arm 63 and of which the mating latching-action toothing formation 62 is located opposite the latching-action element-toothing formations 61 and, when the rotary-latch elements 7, 8 engage around the locking bolt, engages in the latching-action element-toothing formations 61, the rotary latch 10 being retained in an upright state in the process. The latching-action element-toothing formations 61 have at least three teeth, it being possible for the mating latching-action toothing formation 62 of the latching member 66 to butt against, or engage in, the outside circumferential surface 71, on the rear side of the rotary latch, thereof. In FIG. 4, the mating latching-action toothing formation 62 engages in the latching-action element-toothing formation 61.

The catch lever 27 is connected to the second, button-actuable release arrangement 12, which is guided and arranged via a crossmember tube 24, such that the locking bolt 6 can be released from the rotary latch 10 from outside the lock case by each of the two release arrangements 13 and 12, via the associated local-release and remote-release levers 2 and 3, respectively, thereof.

According to the invention, the horizontally running lever arm 64 of the catch lever 27 is connected via the remote-release lever 3 to the remotely actuable release arrangement 12, which can be actuated preferably inside the door.

The rotary latch 10 comprises two rotary-latch elements—a top rotary-latch element 7 and a bottom rotary-latch element 8—which have recesses 32, 73, directed towards one another, and have latching-action element-toothing formations 61 on the opposite, outer circumferential surfaces 71, on the rear side of the rotary latch, and are mounted rotatably in their associated rotary securing bolts 40, 41. The rotary securing bolts 40, 41 each have spacer sleeves 93, 94 which, at the same time, bear the common spring 77. The spacer sleeves of all the rotary securing bolts 40, 41, 43, 51 give lever-releasing and spring-assisting movements of the rotary elements in the interior and, at the same time, secure the lock walls firmly in relation to one another.

The two lever arms of the preferably single-part catch lever 27, said lever arms running at right angles to one another, constitute a vertical lever arm 63 and a horizontal lever arm 64. The vertical lever arm 63 is directed approximately parallel to the long-side lock wall 30, the latching member 66 being attached in a lateral projecting manner, in the direction of the rotary latch, on the vertical lever arm 63. The integrally formed horizontal lever arm 64 is directed approximately parallel to the short-side lock wall 44 and extends from the angle region 65 into the corner region of the lock walls 68, 44, alongside the bottom rotary-latch element 8.

The vertical lever arm 63, on the rear side of the rotary latch 10, is connected via the local-release lever 2 to the door-handle-actuable release arrangement 13. The other, horizontal lever arm 64 of the catch lever 27, the horizontal lever arm running at right angles to the vertical lever arm, is guided from the corner region of the two lock walls 44, 30 into the vicinity of the bottom lateral lock-wall part 68, and preferably has an end-side lever-arm cutout 46 directed towards the short-side lock wall 44. The engagement continuation 45 of the button-actuable remote-release lever 3 engages in the lever-arm cutout 46.

It is thus possible for the catch lever 27 to be actuated by the button-actuable remote-release lever 3 and the door-handle-actuable local-release lever 2 independently of one another. In this case, the two release levers 2, 3 may also be connected to the catch lever 27, in particular to the lever arms 63, 64 thereof, via differently designed latching elements.

FIG. 4 illustrates a perspective view of the door lock 1 in the open state, without the two cover parts 78, 79 (FIG. 3). The lock case 5 comprises a depression-like or case-like container. The container has, as contiguous wall parts, the depression base 38 and short-side lock walls bent at right angles—a top short-side lock wall 29 and a bottom short-side lock wall 44—and the long-side lock wall 30 which is bent likewise at right angles to the depression base 38. The opposite, right-hand lock wall, belonging to the left-hand long-side lock wall 30, is divided in two into a top right-hand lock-wall part 28 and a bottom right-hand lock-wall part 68, it also being the case that the case opening 14, located in the depression base 38, is located approximately centrally between the two wall parts 28, 68, it being possible for the locking bolt 6 to be moved into the lock case 5 and out of the lock case 5 through said opening.

In its angle region 65 between the two lever arms 63, 64, the flat catch lever 27, which is of approximately right-angled design, is mounted pivotably in the corner region between the lock walls 44 and 30 by means of a rotary securing bolt 43. In the direction of the top cover part 79 (not depicted), the vertical lever arm 63 of the catch lever 27, which terminates with the latching member 66 and is directed away from the rotary latch, has a blocking bolt 25 which terminates freely on the inside in front of the cover part 79. The upright, door-handle-actuable local-release lever 2, which terminates freely with the inclined lever head 74, is mounted such that it can be pivoted about the axis 67 in the rotary-mounting screw 50, which is parallel to the cover part. As is shown in FIGS. 1*a* and 2, the rotary-mounting screw 50 is located on a rotary-hole extension 52 which is integrally formed on the bottom cover part 78, approximately in the longitudinal centre, in a form in which it is angled at right angles and projects respectively to the outside. The local-release lever 2 may also be mounted pivotably by means of two rotary-hole extensions, which are integrally formed at right angles, if a second rotary-hole extension, which is spaced apart in parallel, is likewise provided on the top cover part 79. In the foot region of the local-release lever 2, in the vicinity of the vertical lever arm 63, the cam 49, directed to the side of the short-side lock wall 29, is integrally formed and is located transversely to the upright blocking bolt 25. The upright blocking bolt 25 is secured in a vertically projecting manner on the flat lever arm 63 and is located between the cam 49 and the long-side lock wall 30. The catch lever 27, in the region of the latching member 66, may be forced in the direction of the long-side lock wall 30 by a compression spring (concealed). In this case, the cam 49 is also located above the region of the mating latching-action toothing formations 62 of the latching member 66. On its foot region, the local-release lever 2 has the projecting supporting protrusion 48, which allows a controlled pivoting movement about the axis 67 in the direction of the long-side lock wall 30 and back.

In FIG. 5, the button-actuable release arrangement 12 contains a crossmember tube 24 which is fastened, in particular screwed or welded, by means of the angle-retaining part 35 of the step-like tube-retaining angle part 17, said angle-retaining part being fastened on the bottom right-hand cover part 78, and, in said crossmember tube, the tension cable 16 is guided up to the contact device 11 (not depicted), which is arranged preferably centrally on the crossmember tube 24 and is directed vertically upwards.

The tube-retaining angle part 17 (in FIG. 4) is preferably of single-part design and comprises the angle-part member 36, which is integrally formed on the bottom cover part 78, a step spacer part 4, which is offset to the side of the cover part 78, and the tube-retaining part 35, one end side of the crossmember tube 24 being fastened thereon, preferably screwed or welded thereto. The tube-retaining angle part 17, along with the bottom cover part 78 and the rotary-hole extension 52, preferably constitutes an integral structural element.

On the angle-part member 36, which is located outside the lock case 5, the remote-release lever 3 is provided in a pivotably mounted manner by means of a rotary-mounting screw 47. The remote-release lever 3 has an engagement continuation 5 which extends, through a window 55 (FIG. 3) in the bottom cover part 78, into the lock case 5 and, there, projects into the lever-arm cutout 46 of the horizontal lever arm 64. The remote-release lever 3 is assigned a cable mount 96 provided with a securing hole 70, the securing hole 70 securing a cable hook 9 which is reinforced in relation to the tension cable 16.

In FIG. 4, the illustration of the known spring-assisting means for the catch lever 27 has been dispensed with in order for the interior arrangement in the lock case 5 to be more easily understood. The spring may be located between the long-side lock wall 30 and the end of the vertical lever arm 63 and be designed as a compression spring, of which the spring force is directed in the rotary-latch direction.

For a more detailed explanation of the remotely actuable release arrangement 12 outside the lock case 5, FIGS. 6, 6*a* and 6*b* will be looked at together. In this case, FIG. 6 shows a perspective illustration of the contact device 11 inside the door, with a tension cable 16 and with the crossmember tube 24 cut away longitudinally, and FIGS. 6*a* and 6*b* show further details in this respect. The crossmember tube 24 has on its top side a longitudinal-slot opening 88, in which the contact device 11 with the button 69 is fastened.

The button 69 has an approximately cuboidal, hollow lateral body which is open at the bottom and closed at the top and comprises two mutually opposite, conforming contact-body side parts 80, 81, which each have a reinforced, inwardly directed, enclosing border region, and a contact-body centre part 99, which is located between the reinforced border regions, it being possible for the button surface 97 of the three parts 80, 81, 99 to be profiled in accordance with a finger or thumb, in particular in undulating form, for manual actuation. The button 69 projects from the longitudinal-slot opening 88 by way of its parts 80, 81, 97.

Adjacent to the longitudinal-slot opening 88 is an arresting-action longitudinal tube opening 98, which preferably has a narrower width than the longitudinal-slot opening 88 and is guided up to a round abutment edge 42. The button 69 is connected to a button-retaining body 85 which comprises a clamping-body part 59, which is located beneath the arresting-action longitudinal tube opening 98 in the crossmember-tube region, and a button-retaining-body part 100. The button-retaining body 85 is fastened in the arresting-action longitudinal opening 98 by its clamping-body part 59, which is adapted to the inside of the tube, the fastening taking place by means of an associated clamping screw 57 and of a clamping ring 58, which is located beneath the clamping-screw head and of which the diameter is greater than the width of the arresting-action longitudinal tube opening 98.

The button-retaining-body part 100 is narrowed in relation to the clamping-body part 59 such that it extends into the cavity of the button 69, in particular of the lateral body. The inner button-retaining-body part 100, which is provided between the tube and button cavity, is preferably designed like the body of a bird and has, on the front side, a rotary-mounting bolt 60 for the button 69, and on the head/rear side a supporting spring 20 for the button 69. In this case, a vertical hole-like indent 92 is made on the head/rear side of the button-retaining body 85, a part of the supporting spring 20 being secured vertically in said indent and the spring supporting the button 69 in the reinforced border region by way of its free, top end part. The rotary-mounting bolt 60 is guided in a first, preferably vertical plug-on shaft 90 belonging to the contact-body side parts 80, 81, the first plug-on shaft 90 and the rotary-mounting bolt 60 being located within the crossmember tube 24. While the button-retaining body 85 is arranged in the rear half of the button 69, a rocker-like pivoting body 83 with an inclined rocker axis is secured and mounted pivotably on the contact-body side parts 80, 81 in the front half, a first transverse pivoting bolt 82 being provided at the top end of the pivoting body 83 and preferably above the crossmember tube 24 and being guided in a second, preferably vertical plug-on shaft 101 of the contact-body side parts 80, 81. The rocker-like pivoting body 83 rests by way of the bottom, bent end region, which is located beneath the contact-body side parts 80, 81, on the inner tube wall 102 and has a largely convexly curved rolling surface 103 which extends essentially from the bearing surface on the inner tube wall 102 to the vicinity of the top end region of the first transverse pivoting bolt 82 of the pivoting body 83. Provided in the bottom end region is a second transverse pivoting bolt 21, with a cable attachment 84 in a plug-in opening 22, it being possible for the transverse pivoting bolt 21, which secures the tension cable 16 on the end side, to be introduced into the plug-in opening 22. Formed in the pivoting body 83, extending in the cable direction from the plug-in opening 22, is a crest-like guide clearance 87 with an associated convexly curved cable-guide path 91, which is directed upwards likewise from the plug-in opening, for inflection-free loading of the tension cable 16. The pivoting body 83 is in an upright state, in the direction of the cable 16, by the angle $\alpha$, which, at the same time, constitutes the angle between the rocker axis, as connecting axis between the two transverse pivoting bolts 82, 21, and the inner tube wall 102. The pivoting body 83 is guided between the contact-body side parts 80, 81 and has approximately the same width as the contact-body centre part 99.

When the button 69 is pushed in the pushing direction 89 (arrow), the angle $\alpha$ between the pivoting-pin-connecting plane and the inner tube wall 102 is reduced. The pivoting body 83 rolls on the rolling surface 103 in the cable direction and, in the process, the cable 16 is wound around the cable-guide path 91. As a result, the cable 16 is tensioned and the remote-release lever 3 is actuated, the latter then opening the rotary latch 10 via the further functional elements in the interior of the lock case 5. The button 69 which is pushed in the pushing direction 89 (arrow), is pushed back into the starting position again by the supporting spring 20 following completion of the pushing operation, in which case the pivoting body 83 also resumes the angle $\alpha$.

FIG. 6*b* shows a perspective illustration of the adjustable contact device 11, which can be arrested by a clamping-action screw-connection 57, 58 on the crossmember tube 24 according to FIG. 6. The arresting-action longitudinal tube opening 98, which is located in the crossmember tube 24, contains the clamping-body part 59 of the button-retaining body 85. The clamping body part 59 is rounded in adaptation to the inner tube wall, on its retaining-body bearing 86, and butts against the inner wall of the crossmember tube 24.

Provided outside the outer tube wall are a clamping screw 57, which can be actuated preferably by a socket-head-screw wrench, and a clamping ring 58, which is located between the clamping-screw head and outer tube wall and by means of which the button-retaining body 85, and thus also the angle a of the rocker-like pivoting body 83, can be arrested in a manner in which they have been adjusted in relation to the inner tube wall 102. By means of the clamping screw 57, the clamping ring 58 and of the clamping-body part 59, the tension cable 16 is tensioned such that at least the tension cable 16 runs virtually rectilinearly in the crossmember tube 24, and that a pressure to which the button 69 is subjected pivots the remote-release lever 3. The clamping-body part 59 is preferably no wider than the longitudinal-slot opening 88, in order that quick straightforward installation of the contact device 11 in the crossmember tube 24 can take place.

In the transition region from the arresting-action longitudinal tube opening 98 to the longitudinal slot opening 88, the clamping-body part 59 is provided respectively with a left-hand transverse stop edge 104 and a right-hand transverse stop edge 105, which are directed transversely to the progression of the tube and each run up to the contact-body centre part 99, which terminates, in the longitudinal direction of the tube, a little way above the retaining-body bearing 86, the contact-body side parts 80, 81 butting, by way of their continuing border regions 106, 107, against the transverse stop edges 104, 105 of the clamping-body part 59 such that the button 69 is secured in a predetermined state in its normal position (in the non-released position).

The door lock 1 according to the invention functions as follows:

In the opening phase of the door lock 1, there is no locking bolt 6 located in the rotary latch 10. The latching member 66 has its mating toothing formation 62 deflected out of the latching-action element-toothing formations 61 of the rotary-latch elements 7, 8. The common spring 77 of the rotary-latch elements 7, 8 keeps the rotary latch 10 open by the tensile force, with result that, at the same time, there is a readiness for accommodating the locking bolt 6 on the door frame of the vehicle. It is likewise the case that the compression spring (not depicted) assigned to the catch lever 27 pushes the blocking bolt 25 away from the long-side lock wall 30 and the latching member 66 butts, in another securing position, against the outer circumferential surface 71 in the region of the latching-action element-toothing formations 61.

In the opening phase, the latching member 66 thus does not engage in the latching-action element-toothing formation 61 of the rotary-latch elements 7, 8, but rather butts against the outer circumferential surface 71 (representing the two circumferential surfaces on the rotary-latch elements 7, 8). The open state of the rotary latch 10 means, at the same time, that the door of the vehicle is open.

When the door is closed, the locking bolt 6 passes the lock-case opening 14 in the direction S (arrow) and is pushed, by the momentum of the door, against those regions of the recesses 32 and 73 which are in the vicinity of the latching member 66, such that the common spring 77 is extended, the rotary latch elements 7, 8 pivoting about the rotary retaining bolts 40, 41 into another position, i.e. passing into engagement around the locking bolt 6 and thus enclosing the latter in a latch-like manner.

By virtue of the rotation of the rotary-latch elements 7, 8, the latching-action element-toothing formations 61 are directed towards the long-side lock wall 30, and thus the latching member 66, such that the mating toothing formation 62 thereof can engage in the latching-action element-toothing formations 61, contact being made in the process. The rotary latch 10 is thus firmly closed.

When the remotely actuable release arrangement 12 is actuated, the following takes place:

By pushing on the button 69, by way of the transmitting tension cable or rod 16 moving in the cable-tensioning direction (arrow), the engagement continuation 45, which is located in the lever-arm cutout 46, is pushed onto the horizontal lever arm 64 of the catch lever 27, which is pivoted away from the short-side lock wall 44 in the direction of the rotary-latch element 8. As a result, the latching member 66, which is integrally formed on the vertical lever arm 63, which is directed away from the rotary latch, unlatches from, and pivots out of, the two latching-action element-toothing formations 61, with result that, by virtue of the spring force of the common spring 77 of the rotary-latch elements 7, 8, the rotary latch 10 is released and the locking bolt 6 can leave the lock case 5 in the direction Ö (arrow), passing the case opening 14 in the process, which results in the door being opened. In order to adjust the position of the crossmember tube in relation to the lock case, the screw-connection of the crossmember tube 24 on the tube-retaining angle part 17 is released until the crossmember tube 24 can be pivoted about the screw-connection. In addition, the screw-connection of the remotely actuable release mechanism on the crossmember tube is released, with the result that said screw-connection can be displaced longitudinally on the crossmember tube. The crossmember tube may then be moved into the appropriate position on a door, the remotely actuable release arrangement 12 being displaced longitudinally on the crossmember tube by the tension cable or a corresponding rod during the pivoting operation, depending on whether the tension cable or the rod is drawn out of the crossmember tube, or pushed into the same, by the pivoting operation. If the crossmember tube has reached a desired pivoting position in relation to the lock or in relation to the door, the crossmember tube may be fastened on the door or a door frame by means of its fastening device, such as a tube crimping formation, which is located opposite the lock case, whereupon the remotely actuable release arrangement is then secured on the crossmember tube by virtue of the adjusting screw being tightened and, if appropriate, the crossmember tube is likewise secured again on the tube-retaining angle.

When the locally actuable release arrangement 13 is actuated, the following takes place:

By pulling the door handle 18, the upright, slightly inclined head 74 of the door-handle-actuable local-release lever 2 is moved in the direction of the crossmember tube 24, the local-release lever 2 being pivoted about the axis 67. In this case, the integrally formed cam 49 pushes against the end-side spring-assisted blocking bolt 25 of the vertical lever arm 63, which is directed away from the rotary latch. By movement of the blocking bolt 25 in the direction of the long-side lock wall 30, the mating toothing formation 62 of the latching member 66 is unlatched from, and pivoted out of, the latching-action element-toothing formations 61, with the result that the force of the common spring 77 can take effect. The rotary latch 10 is opened, the rotary-latch elements 7, 8 assuming a new rotary position and releasing the locking bolt 6 from the recesses 32, 73 in the direction Ö (arrow). The door of the vehicle is now open.

The rotary latch 10 is closed by the locking bolt 6 passing into the case opening 14 and by the recesses 32, 73 of the rotary-latch elements 7, 8 being subjected to impact-like loading.

In the case of the door lock according to the invention with pivotable crossmember tube, it is advantageous to reduce the number of transmission levers of the release arrangement arranged on the crossmember tube, it being the case that, since the release mechanism and/or button on the crossmember tube is articulated on the catch lever by a tension cable or a rod, and, in addition, the release mechanism is arranged on the crossmember tube such that it can be displaced longitudinally and secured, the crossmember tube can be pivoted into any desired position. Since the point of articulation of the tension cable or of the rod on the tube-retaining angle part is remote from the point of rotation or pivoting point of the crossmember, the tension cable or the tension rod is drawn out of the crossmember tube, or pushed into the same, to a greater or lesser extent during pivoting of the crossmember tube, it being possible to compensate for these changes by the longitudinally displaceable, remotely actuable release arrangement 12.

LIST OF DESIGNATIONS

1 Door lock
2 Local-release lever
3 Remote-release lever
4 Step-spacer part
5 Lock case
6 Locking bolt
7 Top rotary-latch element
8 Bottom rotary-latch element
9 Cable hook
10 Rotary latch
11 Contact device
12 Remotely actuable release arrangement
13 Locally actuable release arrangement
14 Case opening
15 Door-depression
16 Tension cable
17 Tube-retaining angle part
18 Door handle
19 Door-handle-lever device
20 Button spring
21 Bottom transverse pivoting bolt
22 Plug-in opening
23 Rocker axis
24 Crossmember tube
25 Blocking bolt
26 Platform
27 Catch lever
28 Lock-wall part
29 Top short-side lock wall
30 Long-side lock wall
31 Tube crimping formation
32 Recess

33 Axis of rotation
34 Tube-securing block
35 Tube-retaining part
36 Angle-part member
37 Tube screw-connection
38 Depression base
39 Slot
40 Rotary retaining bolt
41 Rotary retaining bolt
42 Abutment edge
43 Rotary securing screw
44 Bottom short-side lock wall
45 Engagement continuation
46 Lever-arm cutout
47 Rotary-mounting screw
48 Supporting protrusion
49 Cam
50 Rotary-mounting screw
51 Screw-connection
52 Rotary-hole extension
53 Spacer sleeve
54 Spacer sleeve
55 Window
56 Tube-crimping tapered portion
57 Clamping screw
58 Clamping ring
59 Clamping-body part
60 Rotary mount
61 Latching-action element-toothing formations
62 Mating latching-action toothing formation
63 Vertical lever arm
64 Horizontal lever arm
65 Angle region
66 Latching member
67 Axis
68 Lock-wall part
69 Button
70 Securing hole
71 Outer circumferential surface
72 Protrusion
73 Recess
74 Head
75 Head through-passage
76 Cutout opening
77 Common spring
78 Bottom cover part
79 Top cover part
80 Contact-body side part
81 Contact-body side part
82 First top transverse pivoting bolt
83 Pivoting body
84 Cable attachment
85 Button-retaining body
86 Retaining-body bearing
87 Guide clearance
88 Longitudinal-slot opening
89 Pushing direction
90 First plug-on shaft
91 Cable-guide path
92 Indent
93 Spacer sleeve
94 Spacer sleeve
95 Spacer sleeve
96 Cable mount
97 Button surface
98 Arresting-action longitudinal tube opening
99 Contact-body centre part
100 Button-retaining-body part
101 Second plug-on shaft
102 Inner tube wall
103 Rolling surface
104 Transverse stop edge
105 Transverse stop edge
106 Border region
107 Border region α Angle
Ö Opening direction
S Closing direction

What is claimed is:

1. A door lock, in particular for agricultrual vehicles such as tractors, comprising:

a lock case (5) being provided with a case opening (14), the lock case (5) accommodating a locking bolt (6);

spring-assisted rotary-latch elements (7, 8) provided in the lock case (5) for engaging around the locking bolt (6);

a locally first actuable release arrangement (13);

the locally first actuable release arrangement (13) including a catch lever (27) to fix rotary positions of the rotary-latch elements (7, 8) to provide a rotary-latch-element securing engagement in latching-action element-toothing formations (61), the rotary-latch elements (7,8) being directed away from a rotary latch (10) engagingly disposed around the locking bolt (6);

the catch lever (27) having two lever arms (63, 64) directed approximately at right angles to one another, the catch lever (27) being mounted pivotably in an angle region (65), the catch lever (27) including a latching member (66) disposed on an end side of one lever arm (63);

a mating latching-action toothing formation (62) being located opposite the latching-action element-toothing formations (61), the catch lever (27) engaging in latching gaps of the latching-action element-toothing formations (61) when the rotary-latch elements (7, 8) engage around the locking bolt (6);

the catch lever (27) being connected to a remotely second actuable release arrangement (12), the remotely second actuable release arrangement (12) being guided and arranged in a crossmember tube (24), the crossmember tube (24) being pivotable relative to the lock case (5);

a cable or rod (16) connecting the remotely second actuable release arrangement (12) to the catch lever (27), the remotely second actuable release arrangement (12) being arranged on the crossmember tube (24) so that the remotely second actuable release arrangement (12) can be displaced longitudinally and secured in order for the crossmember tube (24) to pivot relative to the lock case (5) and for the remotely second actuable release arrangement (12) to be adjusted to a pivot angle.

2. Door lock according to claim 1, wherein the locally actuable release arrangement (13) constitutes a release arrangement which can be actuated by a door handle from outside a door, and the remotely actuable release arrangement (12) constitutes a release arrangement which can be actuated by a button disposed inside the door.

3. Door lock according to claim 1, wherein the lock case (5) constitutes a depression-like or case-like container which has, as contiguous wall parts, a depression base (38), a first short-side lock wall (29), an opposite second short-side lock wall (44) and a first long-side lock wall (30), a second long-side lock wall being divided in two parts to provide a first lock-wall part (28) and a second lock-wall part (68) the case opening (14) being located approximately centrally between the two lock-wall parts (28, 68), and the locking bolt (6) being movable into the lock case (5) and out of the lock case (5) through said case opening (14).

4. Door lock according to claim 3, wherein the two interconnected lever arms (63, 64) of the catch lever (27) provide a vertical lever arm (63) and a horizontal lever arm (64), the vertical lever arm (63) having the latching member (66) thereon and being directed approximately parallel to the first long-side lock wall (30), and the horizontal lever arm (64) being directed approximately parallel to the second short-side lock wall (44) and extending into the corner region of the lock walls (44), alongside the rotary-latch element (8).

5. Door lock according to claim 4, wherein the horizontal lever arm (64) of the catch lever (27) is connected to the remotely second actuable release arrangement (12) which can be actuated from inside, and to a remote-release lever (3) thereof.

6. Door lock according to claim 4, wherein the vertical lever arm (63) of the catch lever (27), which is assigned to the rotary latch (10), is connected to the first actuable release arrangement (13) and to a local-release lever (2) thereof.

7. Door lock according to claim 4, wherein the catch lever (27) is provided with a spring to be spring-assisted so that pressure of the spring is directed in direction of the rotary latch (10).

8. Door lock according to claim 4, a remote-release lever (3) and a local-release lever (2) are assigned to the catch lever (27) independently of one another, the remote-release lever (3) being connected to the horizontal lever arm (64) by an end-side engagement element (45) in each case, and the local-release lever (2) being connected to the vertical directed lever arm (63) associated therewith.

9. Door lock according to claim 3, wherein the first short-side lock wall (29) has a rectangular cutout opening (76) in a corner region disposed between the first long-side lock wall (30) and a cover part (79).

10. Door lock according to claim 3, wherein the case opening (14), which is provided between the lock-wall parts (28, 68), is provided for movement of the rotary-latch elements (7, 8) beyond a plane of the lock-wall parts (28, 68).

11. Door lock according to claim 1, wherein the first actuable release arrangement (13) is provided with a pivotable door handle (18) which is incorporated in a door-handle depression (15), the door handle (18) being connected to a lever device (19), which is fastened on the door-handle depression (15), and a platform (36), which fastened on said lever device (19), in direction transverse to the door-handle depression (15), a local-release lever (2) being mounted on the catch lever (27) and being pivotable by movement of the platform (26).

12. Door lock according to claim 1, wherein a local-release lever (2) is connected, within the lock case (5), to a blocking bolt (25), which projects vertically from the lever arm (63) and, when the local-release lever (2) is pivoted, the blocking bolt (25) is pivoted out of the latching-action element-toothing formations (61).

13. Door lock according to claim 12, wherein the local-release lever (2) has a supporting protrusion (48) which, in a normal position, butts against the lock case (5).

14. Door lock according to claim 12, wherein the local-release lever (2) is provided with a head (74) which has a protrusion (72) and is inclined away from the second actuable release arrangement (12), the head (74) being provided with a through-passage (75) for reducing amount of material required for said head (74) and for rendering the head (74) easier to operate.

15. Door lock according to claim 1, wherein the release arrangement (12), which is actuated by a button inside a door, includes, outside the lock case (5), a single-step tube-retaining ange part (17), the pivotable crossmember tube (24) being fastened on said angle part (17) and being open in direction of the lock case (5), the crossmember tube (24) being provided at an opposite free end with a tube crimping formation (31) which is installed in a door-adapted manner and which is provided with a slot (39), the release arrangement (12) also includes a contact device (11), which is located on and in the crossmember tube (24) and from which a tension cable (16), reinforced at an end by a cable hook (9), is guided to a perforated remote-release lever (3), the remote-release lever (3) being connected to the tube-retaining angle part (17) for accommodating the cable hook (9).

16. Door lock according to claim 15, wherein the tube-retaining angle part (17) includes an angle-part member (36), which is disposed on a border side of a bottom cover part (78), a step spacer part (4) being offset to a side of the lock case (5) from the cover part (78), and a tube-retaining part (35) having one end side of the crossmember tube (24) fastened, screwed or welded thereon.

17. Door lock according to claim 15, wherein the tube-retaining angle part (17) is a securing and spacer element which is minimalized in material and shape.

18. Door lock according to claim 1, wherein the lock case (5) has a cover divided into a first bottom cover part (78) and a second top cover part (79), the first bottom cover part (78) being provided with a projecting rotary-hole extension part (52) which is angled outwards at right angles, to which a local-release lever (2) is screwed in a pivotably mounted manner, and on which a tube-retaining angle part (17) is integrally formed, the crossmember tube (24), which protects the cable (16), being fastened on said extension part (52).

19. Door lock according to claim 18, wherein both the rotary-hole extension part (52) and the tube-retaining angle part (17) are arranged on the first bottom cover part (78), at right angles to one another.

20. Door lock according to claim 18, wherein the top cover part (79) is fastened by at least two screw-connections (51, 40) on a depression base (38) with associated interposed spacer sleeves (53, 54, 93) disposed inside the lock case (5).

21. Door lock according to claim 20, wherein the first bottom cover part (78) is secured firmly on the depression base (38) by at least two screw-connections (41, 43) with associated spacer sleeves (94, 95) disposed inside the lock case (5).

22. Door lock according to claim 18, wherein the tube-retaining angle part (17) is attached to, integrally formed on or screwed to the first bottom cover part (78).

23. Door lock according to claim 18, wherein the local-release lever (2) is arranged between the cover parts (78, 79), the local-release lever (2) being secured in a pivotably mounted manner on the rotary-hole extension part (52), which is angled outwards at right angles by a rotary-mounting screw (5), of which an axis (67) is directed parallel to the one lever arm (63).

24. Door lock according to claim 18, wherein the bottom cover part (78) is a securing part for the local-release lever (2) and for a remote-release lever (3), which is mounted pivotably on the tube-retaining angle part (17), which is integrally provided on the cover part (78).

25. Door lock according to claim 24, wherein the cable (16) is connected to a functional interior of the lock case (5) by an engagement continuation (45) and the remote-release lever (3), which is mounted to be pivoted about an axis (33).

26. Door lock according to claim 18, wherein the top cover part (79) is fitted in an edge-levelled manner into lock walls (30, 29, 28) by screw-connections (51, 40) including spacer sleeves (53, 54, 93), which are arranged between a depression base (38) and the top cover part (79), the bottom cover part (78) being fitted in a levelled manner between lock walls (30, 68) and rests on a short-side lock wall (44).

27. Door lock according to claim 18, wherein a remote-release lever (3) is fastened on the tube-retaining angle part (17) by a rotary-mounting screw (47), a window (55) being provided in the bottom cover part (78) of the lock case (5) within a region of the remote-release lever (3) so that the catch lever (27), which is pivotable in the lock case (5), can be actuated by an engagement continuation (45), which is integrally provided on the remote-release lever (3).

28. Door lock according to claim 18, wherein supporting protrusion (48) of the local-release lever (2) butts against an edge of a long-side lock wall (30) in a loading-free case.

29. Door lock according to claim 18, wherein the cross-member tube (24), with an associated tube crimping formation (31) located at a free tube end, is fastened on a tube-retaining part (35) of the tube-retaining angle part (17) so that it can be adjusted by a tube-securing block (34) and a screw-connection (37).

30. Door lock according to claim 18, wherein in a direction of the top cover part (79), in a latching-member region, the one lever arm (63) of the catch lever (27) has a blocking bolt (25), said one lever arm (63) terminating with a latching member (66), and being directed away from the rotary latch (10), the blocking bolt (25) terminating freely in front of the top cover part (79) and being directed vertically in relation to the one lever arm (63).

31. Door lock according to claim 30, wherein in a foot region of the local-release lever (2), in a vicinity of the one lever arm (63), a cam (49) is directed to a side of a short-side lock wall (29), the cam (49) being integrally provided as an associated counterpart to the transversely located blocking bolt (25).

32. Door lock according to claim 31, wherein the cam (49) is located above a region of mating latching-action toothing formations (62) of the latching member (66).

33. Door lock according to claim 30, wherein the catch lever (27), in a region of the latching member (66), is forced in direction of a long-side lock wall (30) by a compression spring.

34. Door lock according to claim 18, wherein the local-release lever (2) is an upright freely terminating lever, which is provided with an inclined lever head (74) mounted so that it can be pivoted about an axis (67) by a rotary-mounting screw (50), the rotary-mounting screw (50) being located on a rotary-hole extension (52) which is provided on the bottom cover part (78), approximately in a longitudinal center thereof so that it is angled at right angles and projects respectively to an outside of the lock case (5).

35. Door lock according to claim 34, wherein the local-release lever (2) is secured pivotably by two rotary-hole extensions which are spaced apart in a parallel arrangement, an associated identical rotary-hole extension being provided on the top cover part (79).

36. Door lock according to claim 34, wherein on a foot region, the local-release lever (2) has a projecting supporting protrusion (48) on a foot region thereof to allow a controlled pivoting movement about the axis (67) of the rotary-hole extension (52) in a direction toward a long-side lock wall (30) and back therefrom.

37. Door lock according to claim 18, wherein the cross-member tube (24) of the second actuable release arrangement (12) is fastened, screwed or welded to a tube-retaining part (35) of the tube-retaining angle part (17).

38. Door lock according to claim 1, wherein the rotary latch (10) has two rotary-latch elements including a top rotary-latch element (7) and a bottom rotary-latch element (8), which have recesses (32, 73) directed towards one another, and have the latching-action element-toothing formations (61) on opposite outer circumferential surfaces (71) thereof, and a rear side of the rotary latch (10), the rotary-latch elements (7, 8) being rotatably in associated rotary securing bolts (40, 41), the rotary securing bolts (40, 41) each having enclosing spacer sleeves (93, 94) which bear a common spring (77).

39. Door lock according to claim 1, wherein enclosing spacer sleeves of all rotary securing bolts (40, 41, 43, 51) provide lever-releasing and spring-assisting movements of rotary elements in an interior of the lock case (5) and also secure a depression base (38) and cover parts (78, 79) of the lock case (5) firmly in relation to one another.

40. Door lock according to claim 1, wherein the catch lever (27) is actuated by a remote-release lever (3) or by a local-release lever (2) independently of one another.

41. Door lock according to claim 40, wherein the two release levers (2, 3) are connected to lever arms (63, 64) of the catch lever (27) by recessed latching-element pairs.

42. Door lock according to claim 1, wherein the catch lever (27), which is of approximately right-angled construction, is secured pivotably in a corner region between two lock walls (44, 30) by a rotary securing bolt (43) located in the angle regions (65).

43. Door lock according to claim 1, wherein the cable (16) in the crossmember tube (24) is guided up to a contact device (11), which is arranged centrally on the crossmember tube (24) and is directed vertically upwards out of the crossmember tube (24).

44. Door lock according to claim 1, wherein an angle-part member (36) is located outside the lock case (5), a remote-release lever (3) is pivotably mounted on the angle-part member (36) by a rotary-mounting screw (47).

45. Door lock according to claim 44, wherein a cable mount (96) is integrally provided on the remote-release lever (3), the cable mount (96) being provided with a securing hole (70), the securing hole (70) securing a cable hook (9) to the cable mount (96), the cable hook (9) being reinforced in relation to the cable (16), the cable mount (96) and an engagement continuation (45) being directed in parallel relative to each other.

46. Door lock according to claim 1, wherein a spring assigned to the catch lever (27) is located between a long-side lock wall (30) and an end of the one lever arm (63), the spring being a compression spring.

47. Door lock according to claim 1, where the crossmember tube (24) has a longitudinal-slot opening (88) and an arresting-action longitudinal tube opening (98) in a longitudinal center of a top side thereof, in which a contact device (11) with a button (69) is fastened.

48. Door lock according to claim 47, wherein the button (69) has an approximately cuboidal lateral body which has an open bottom and a closed top, is hollow overall and includes two mutually opposite conforming contact-body side parts (80, 81), reinforced border regions of the button (69) are located copposite one another, an interposed contact-body center part (99) of the button (69) is located between said side parts (80, 81) and is at least of a same thickness in the border regions, a contact surface (97) of the three parts (80, 81, 99) being profiled optionally in accordance with a finger or thumb for manual actuation.

49. Door lock according to claim 48, wherein a transversely located rotary-mounting bolt (60) is guided in a first vertical plug-on shaft (90) belonging to the contact-body side parts (80, 81), the first plug-on shaft (90) and the rotary-mounting bolt (60) being located within the button (69).

50. Door lock according to claim 48, wherein a button-retaining body (85) is arranged in a region of a rear half of the button (69) and, in a front half of the button (69), a rocker-like pivoting body (83) with an inclined rocker axis is secured and mounted pivotably on the contact-body side parts (80, 81), a first transverse pivoting bolt (82) being provided at a top end of the pivoting body (83) and outside the crossmember tube (24), in the button cavity, and being guided in a second vertical plug-on shaft (101).

51. Door lock according to claim 50, wherein the rocker-like pivoting body (83) has a bottom end region thereof, located beneath the contact-body side parts (80, 81), resting on a bottom inner tube wall (102), and has a largely convexly curved rolling surface (103) extending from a bearing surface on the inner tube wall (102) to a top end region of the first transverse pivoting bolt (82) of the pivoting body (83).

52. Door lock according to claim 51, wherein provided in the bottom end region of the pivoting body (83) is a second transversely located transverse pivoting bolt (21), with a cable attachment (84) in a transversely located plug-in opening (22).

53. Door lock according to claim 52, wherein provided in the pivoting body (83), extending in a direction of the cable (16) from the plug-in opening (22), is a crescent-like guide clearance (87) for inflection-free loading of the cable (16).

54. Door lock according to claim 50, wherein the pivoting body (83) in a normal position is in an upright state, in a cable-attachment direction, by an angle ($\alpha$), which is provided between a rocker axis (23), between two transverse pivoting bolts (21, 82), and an inner tube wall (102).

55. Door lock according to claim 54, wherein when the button (69) is pushed in a pushing direction (89), the angle ($\alpha$) is reduced and the pivoting body (83) rolls on a rolling surface (103) in the cable-attachment direction and, also, the cable (16) winds around a curved cable-guiding path (91) in a guide clearance (87) with an exertion of tension.

56. Door lock according to claim 50, wherein the arresting-action longitudinal tube opening (98), which is located in the crossmember tube (24), contains a clamping-body part (59) of the button-retaining body (85), the clamping-body part (59) being rounded in adaptation to an inner tube wall (102) of the crossmember tube (24) and butting against the inner wall of the crossmember tube (24).

57. Door lock according to claim 56, wherein provided outside an outer tube wall of the crossmember tube (24) are a clamping screw (57), which can be actuated by a socket-head-screw wrench, and a clamping ring (58), which is located between a head of the clamping screw (57) and the outer tube wall, and by means of which the button-retaining body (85), and thus also the angle (a) of the rocker-like pivoting body (83), are arrested to be adjusted in relation to the inner tube wall (102).

58. Door lock according to a claim 56, wherein the clamping-body part (59) is constructed to be equal to or narrower than a width of the longitudinal-slot opening (88), for straightforward installation of the contact device (11) in the crossmember tube (24).

59. Door lock according to claim 56, wherein in a transition region from the arresting-action longitudinal tube opening (98) to the longitudinal-slot opening (88), the clamping-body part (59) is provided respectively with a left-hand reansverse stop edge (104) and a right-hand transverse stop edge (105) which are directed transversely to a progression of the crossmember tube (24) and each run up to a contact-body center part (99), which terminates, in a longitudinal direction of the crossmember tube (24), a little way above a retaining-body bearing (86), the contact-body side parts (80, 81) butting, by way of continuing border regions (106,107) thereof, against the transverse stop edges (104, 105) of the clamping-body part (59) so that the button (69) is secured in a predetermined state in a normal position thereof.

60. Door lock according to claim 47, wherein the button (69) projects from the longitudinal-slot opening (88), the adjacent arresting-action longitudinal tube opening (98) having a narrower width than the longitudinal-slot opening (88).

61. Door lock according to claim 47, wherein the button (69) is connected to a button-retaining body (85) located in the crossmember tube (24), the button-retaining body (85) includes a clamping-body part (59), which is assigned to the arresting-action longitudinal tube opening (98) in a crossmember-tube region, and a button-retaining-body part (100) is assigned to a button cavity.

62. Door lock according to claim 61, wherein the button-retaining body (85) is fastened in the arresting-action longitudinal opening (98) on the crossmember tube (24) by the clamping-body part (59) thereof, a surface of the clamping-body part (59) is adapted to an inside of the crossmember tube (24), a fastening thereof being provided by an associated clamping screw (57) actuated from outside, and by a clamping ring (58) located beneath a head of the clamping screw (57) and resting on the arresting-action longitudinal tube opening (98), the head of the clamping screw having a diameter greater than a width of the arresting-action longitudinal tube opening (98).

63. Door lock according to claim 61, wherein the button-retaining-body part (100) is narrowed in relation to the clamping-body part (59) so that it extends into a rear portion of the button cavity and is constructed like a body of a bird and has, on a front side, a rotary-mounting bolt (60) located transversely to the crossmember tube (24) and, on a head/rear side, a supporting spring (20) is provided for the button (69), the supporting spring (20) being guided vertically onto the button (69) on an inside thereof.

64. Door lock according to claim 63, wherein a hole-like indent (92) is provided on the head/rear side of the button-retaining body (85), the supporting spring (20) being secured vertically in said indent (92) and supporting the button cavity by a free top end thereof.

* * * * *